US008406668B2

(12) United States Patent
Kageyama

(10) Patent No.: US 8,406,668 B2
(45) Date of Patent: Mar. 26, 2013

(54) FIXING DEVICE AND IMAGE FORMING APPARATUS INCLUDING THE SAME

(75) Inventor: Hiroyuki Kageyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 477 days.

(21) Appl. No.: 12/423,208

(22) Filed: Apr. 14, 2009

(65) Prior Publication Data

US 2009/0257795 A1 Oct. 15, 2009

(30) Foreign Application Priority Data

Apr. 14, 2008 (JP) ..... P2008-105100

(51) Int. Cl.
*G03G 15/20* (2006.01)

(52) U.S. Cl. ..... 399/329; 399/122; 399/333

(58) Field of Classification Search ..... 399/122, 399/320, 328–331, 334; 219/216, 244
See application file for complete search history.

(56) References Cited

U.S. PATENT DOCUMENTS

| | | | | |
|---|---|---|---|---|
| 5,869,808 | A * | 2/1999 | Hyllberg | 219/216 |
| 6,243,559 | B1 | 6/2001 | Kurotaka et al. | |
| 8,150,304 | B2 * | 4/2012 | Kagawa et al. | 399/329 |
| 8,175,508 | B2 * | 5/2012 | Kageyama | 399/329 |
| 2002/0076243 | A1 * | 6/2002 | Nakafuji et al. | 399/329 |
| 2006/0285896 | A1 * | 12/2006 | Beach et al. | 399/333 |
| 2008/0061054 | A1 * | 3/2008 | Shirakata et al. | 219/619 |

FOREIGN PATENT DOCUMENTS

| | | | |
|---|---|---|---|
| JP | 5-019652 | A | 1/1993 |
| JP | 10-307496 | | 11/1998 |
| JP | 2002-333788 | | 11/2002 |
| JP | 2003-057984 | | 2/2003 |
| JP | 2005-339840 | A | 12/2005 |
| JP | 2006-072182 | A | 3/2006 |
| JP | 2008-170887 | | 7/2008 |

* cited by examiner

*Primary Examiner* — Walter L Lindsay, Jr.
*Assistant Examiner* — Benjamin Schmitt
(74) *Attorney, Agent, or Firm* — Nixon & Vanderhye P.C.

(57) ABSTRACT

A fixing device is provided that suppresses loss in heat radiation from both ends in a longitudinal direction which is a direction corresponding to an axial direction of a fixing roller in a heating member so as to be able to uniform distribution of a temperature in the longitudinal direction of the heating member and to attain uniform fixing capability. A planar heat generating element provided in a heating member includes electrodes at both ends in a circumferential direction so that a flowing direction of current flowing through the planar heat generating element is a direction substantially orthogonal to a longitudinal direction as a direction extending along an axial direction of a fixing roller in the planar heat generating element. The planar heat generating element is constituted so that the both ends in the longitudinal direction thereof have larger thickness than that of a center part thereof.

8 Claims, 13 Drawing Sheets

FIXING DEVICE AND IMAGE FORMING APPARATUS INCLUDING THE SAME

CROSS-REFERENCE TO RELATED APPLICATION

This application claims priority to Japanese Patent Application No. 2008-105100, which was filed on Apr. 14, 2008, the contents of which are incorporated herein by reference in its entirety.

BACKGROUND OF THE INVENTION

1. Field of the Invention

The present invention relates to a fixing device for fixing a toner image to a recording medium with heat and pressure and an image forming apparatus including the fixing device.

2. Description of the Related Art

As a fixing device for use in an electrophotographic image forming apparatus such as a copying machine and a printer, a fixing device of heat-roller fixing type has been in wide use. The heat-roller fixing-type fixing device includes a pair of rollers (a fixing roller and a pressure roller) that is brought into contact with each other under pressure. By means of a heating section composed for example of a halogen heater, which is placed in each of or one of the pair of rollers interiorly thereof, the pair of rollers are heated to a predetermined temperature (fixing temperature). With the pair of rollers kept in a heated state, a recording medium such as a recording sheet, having formed thereon an unfixed toner image, is fed to a pressure-contact region of the pair of rollers (i.e., a fixing nip region). Upon the recording sheet passing through the pressure-contact region, the toner image is fixed into place under application of heat and pressure.

Incidentally, a fixing device for use in a color image forming apparatus generally employs an elastic roller constructed by forming an elastic layer made for example of silicone rubber on a surface layer of the fixing roller. By designing the fixing roller as an elastic roller, it is possible for the surface of the fixing roller to become elastically deformed so as to conform to irregularities of the unfixed toner image, wherefore the fixing roller makes contact with the toner image so as to cover the surface of the toner image. This makes it possible to perform satisfactory thermal fixation on the unfixed color toner image that is larger in toner adherent amount than a monochromatic toner image. Moreover, by virtue of a deflection-releasing effect exerted by the elastic layer in the fixing nip region, it is possible to provide enhanced releasability for a color toner that is more susceptible to occurrence of offset than a monochromatic toner. Further, since the fixing nip region is convexly curved in an upper direction (i.e., on a fixing roller side) so as to define a so-called reverse nip configuration, it is possible to attain higher paper-stripping capability of the recording sheet. That is, a paper stripping action of the recording sheet can be produced without using a stripping portion such as a stripping pawl (self-stripping action), wherefore image imperfection caused by the provision of the stripping portion can be eliminated.

Incidentally, in such a fixing device provided in a color image forming apparatus, it is necessary to make a nip width of a fixing nip region wide in order to correspond to increase in speed. One available method of increasing the fixing nip width is to increase the thickness of the elastic layer of the fixing roller or the diameter of the fixing roller. However, in a fixing roller having an elastic layer, the elastic layer can not sufficiently conduct heat, thus, in a case where a heating section is provided inside the fixing roller, there is a problem that a temperature of the fixing roller is not followed when a process speed is increased. On the other hand, when a diameter of the fixing roller is increased, there is a problem that it takes longer time to warm up or power consumption is increased.

As a fixing device provided in a color image forming apparatus to solve such problems, Japanese Unexamined Patent Publication JP-A 10-307496 (1998) discloses a fixing device in a belt fixing system that is configured so that a fixing belt is supported around a fixing roller and a heating roller and the fixing roller and a pressure roller are brought into pressure-contact with each other with the fixing belt interposed therebetween. In the fixing device in a belt fixing system, since the fixing belt with small heat capacity is heated, it takes short time to warm up and it is not necessary to incorporate a heat source such as a halogen lamp in the fixing roller, thus making it possible to provide a thick elastic layer with low hardness made of sponge rubber and the like and to secure a wide nip width.

Furthermore, Japanese Unexamined Patent Publication JP-A 2002-333788 discloses a fixing device in a planar heat generating belt fixing system with a heating section as a planar heat generating element. In the fixing device in a planar heat generating belt fixing system, when heat capacity of the heating section is reduced, the planar heat generating element as the heating section directly generates heat at the same time, thus a thermal response speed is also enhanced compared to a system in which a heating roller is heated indirectly using a halogen lamp or the like and it is possible to attain further shortening of a time for warm up and more energy saving.

However, in a fixing system using a resistance heat generating element as the planar heat generating element, a member with small heat capacity is used so that a surface temperature is determined by a balance between transmitted heat and radiated heat, thus heat radiation volume from both ends of the roller is increased when heat is generated. Accordingly, the temperature of the both ends of the planar heat generating element is lower than that of a center part and it is difficult to obtain uniform temperature distribution over the all areas in a longitudinal direction. As a result, when such a fixing device is applied to an image forming apparatus such as a copier and a printer, variance is generated in a toner fixing temperature and the printing quality is deteriorated.

As a fixing device to solve such problems, Japanese Unexamined Patent Publication JP-A 2003-57984 discloses a fixing device in a DH fixing system, in which, in a fixing system using a fixing roller and a pressure/fixing roller, in order to shorten a time for warm up and uniform distribution of a temperature in an axial direction of the fixing roller surface, a resistance heat generating layer is provided in a lower part of a surface layer of the fixing roller, and a fixing roller is further provided, that transmits, directly to the surface layer, heat generated by making thickness of the resistance heat generating layer have distribution in an axial direction and electrifying the resistance heat generating layer. In the fixing device in a DH fixing system, heat is transmitted to the surface without interposing a core metal with large heat capacity, thus making it possible to shorten a time for warm up, in addition, to reduce unevenness of the surface temperature by generating a large amount of heat matching to heat radiation volume from both ends of the roller.

The fixing device in a planar heat generating belt fixing system described above has the following problems. That is, when the planar heat generating element does not have a self-temperature-controlling function (positive resistance temperature characteristic), during continuous printing of recording sheets having different sizes, a temperature of a non-sheet passing part is excessively increased in the heating roller, thus a step of reducing the temperature of the heating roller to an appropriate level is required, and it takes longer time to perform printing, which reduces productivity significantly. In addition, since a temperature of the both ends in a longitudinal direction of the planar heat generating element is excessively increased, a life of a fixing member is shortened. In order to prevent this, there is considered a method for divisionally controlling the resistance heat generating element, but a detecting member and a control member corresponding to individual heat generating elements are required to divisionally control the resistance heat generating element, which are expensive and complicated.

FIGS. 10A and 10B is a view showing distribution of a temperature, distribution of heat radiation volume, distribution of electric resistance, and distribution of thickness with respect to a length from an end in a longitudinal direction in a heat generating layer provided in a planar heat generating element in a DH fixing system. FIG. 10A shows behavior in a case where a planar heat generating element having a positive resistance temperature characteristic is used and FIG. 10B shows behavior in a case where a planar heat generating element having no positive resistance temperature characteristic is used. In a fixing device in a DH fixing system, in a case where a planar heat generating element has a positive resistance temperature characteristic, when the planar heat generating element is electrified in a longitudinal direction, electric resistance of both ends in the longitudinal direction thereof is increased and heat generation at an end in the electrifying upstream side is accelerated. Then, due to the positive resistance temperature characteristic, the electric resistance of an area of the end in the electrifying upstream side is increased suddenly and electrifying to the planar heat generating element is stopped. Accordingly, the distribution of a temperature in a surface of the planar heat generating element has a state where a temperature in the area of the end in the electrifying upstream side is high.

Furthermore, in the fixing device in a DH fixing system, when the planar heat generating element does not have a positive resistance temperature characteristic, as shown in FIG. 10B, the temperature distribution in a surface of the planar heat generating element is uniform, but voltage of the planar heat generating element is divided in the electrifying direction, thus a temperature rising rate becomes slow even when heat radiation volume is capable of being controlled. Even when electric resistance is adjusted (low resistance) in view of the divided voltage, it is very dangerous to directly supply large current to a fixing roller that is rotating.

SUMMARY OF THE INVENTION

An object of the invention is to provide a fixing device that suppresses loss in heat radiation from both ends in a longitudinal direction of a heating member which is a direction corresponding to an axial direction of a fixing roller so as to be capable of uniforming distribution of temperature in the longitudinal direction of the heating member and attaining uniform fixing capability, and an image forming apparatus including the fixing device.

The invention provides a fixing device comprising:

a fixing roller;

a heating member;

an endless fixing belt supported around the fixing roller and the heating member with tension; and a pressure member facing the fixing roller with the endless fixing belt interposed therebetween, the heating member being in contact with the fixing belt to heat the fixing belt, and in a fixing nip region formed by the fixing belt and the pressure member, a toner image borne on a recording medium being heated and pressurized to be fixed on the recording medium, wherein the heating section that is in contact with the fixing belt to heat the fixing belt in the heating member is formed with a planar heat generating element that extends along an axial direction of the fixing roller and has a positive resistance temperature characteristic;

the planar heat generating element includes electrodes at both ends in a circumferential direction of the planar heat generating element so that a flowing direction of current flowing through the planar heat generating element is a direction substantially orthogonal to a longitudinal direction which is a direction extending along the axial direction of the fixing roller in the planar heat generating element, and has a heat generating layer that generates heat when current is supplied from the electrode, and the heat generating layer is constituted so that both ends in a longitudinal direction of the heat generating layer have larger thickness than that of a center part thereof.

According to the invention, the planar heat generating element having a positive resistance temperature characteristic that is formed in a heating section of a heating member is provided with an electrode at both ends in a circumferential direction so that a flowing direction of current flowing through the planar heat generating element is a direction substantially orthogonal to a longitudinal direction which is a direction extending along the axial direction of the fixing roller in the planar heat generating element. In addition, the planar heat generating element has a heat generating layer that generates heat when current is supplied from the electrode, and the heat generating layer is constituted so that both ends in the longitudinal direction thereof have larger thickness than that of a center part thereof. Since the flowing direction of current is the direction substantially orthogonal to the longitudinal direction of the heat generating layer provided in the planar heat generating element, an area of the both ends in the longitudinal direction of the heat generating layer and an area of the center part thereof are electrified as a parallel connection circuit and are therefore applied with the same voltage.

In such a state, since the heat generating layer is constituted so that the both ends in the longitudinal direction thereof have larger thickness than that of the center part thereof, an electric resistance value decreases and current volume increases in the both ends in the longitudinal direction of the heat generating layer, thus making it possible to increase heat radiation volume in the both ends. Accordingly, it is possible to uniform distribution of a temperature in the longitudinal direction of the heat generating layer by suppressing loss in heat radiation from the both ends in the longitudinal direction of the heat generating layer and to attain uniform fixing capability in the fixing nip region.

Furthermore, in the invention, it is preferable that a length of the center part in the longitudinal direction of the heat generating layer is shorter than a maximum width of a recording medium that passes through the fixing nip region.

According to the invention, a length of the center part in the longitudinal direction of the heat generating layer provided in the planar heat generating element is shorter than a maximum width of a recording medium that passes through the fixing nip region. Thus, in the heat generating layer, the both ends in which large thickness and large heat radiation volume can be set will not be disposed outside an end in a longitudinal direction of the recording medium. Accordingly, the recording medium that passes through the fixing nip region is in contact with the fixing belt in a state of having large heat radiation volume at both ends in the longitudinal direction of the recording medium. As a result, in a state where there is no temperature difference between the both ends and the center part while loss in heat radiation at the both ends in the longitudinal direction thereof being suppressed and distribution of a temperature is uniformed across the entire area in the longitudinal direction, the recording medium passes through the fixing nip region, thus a toner image is uniformly fixed.

Furthermore, in the invention, it is preferable that the fixing roller and the heating member are substantially in parallel to each other in the axial direction of the fixing roller.

According to the invention, the fixing roller and the heating member are substantially in parallel to each other in the axial direction of the fixing roller. Accordingly, when the fixing belt supported around the fixing roller and the heating member with tension slides, it is possible to prevent meandering and maintain high durability of the fixing belt.

Furthermore, in the invention, it is preferable that the heating section of the heating member is formed with the planar heat generating element on an outer or inner circumferential surface of a substrate having a substantially semicircular shape made of a material having high thermal conductivity, and has a coat layer capable of reducing a frictional force between the fixing belt and the heating member on a surface in the side in contact with the fixing belt, and the planar heat generating element has at least the heat generating layer that generates heat by current supplied from the electrode and an insulating layer.

According to the invention, the heating section of the heating member is formed with the planar heat generating element on an outer or inner circumferential surface of a substrate having a substantially semicircular shape made of a material having high thermal conductivity. Accordingly, it is possible to transmit heat generated from the planar heat generating element to the fixing belt through the substrate having high thermal conductivity. In addition, the planar heat generating element has at least the heat generating layer that generates heat by current supplied from the electrode and an insulating layer. Since the planar heat generating element has the insulating layer, when the substrate is metal, it is possible to secure insulation between the substrate and the heat generating layer, which makes the heating member safer. Further, a coat layer capable of reducing a frictional force between the fixing belt and the heating member is formed on a surface in the side in contact with the fixing belt in the heating member. Accordingly, it is possible to maintain high durability of the fixing belt that is in contact with the heating member to slide.

Furthermore, in the invention, it is preferable that the heating section of the heating member is constituted only by the planar heat generating element that has the heat generating layer that generates heat by current supplied from the electrode and is formed into a substantially semicircular shape, and the planar heat generating element has a coat layer capable of reducing a frictional force between the fixing belt and the heating member on a surface in the side in contact with the fixing belt.

According to the invention, the heating section of the heating member is constituted only by the planar heat generating element that has the heat generating layer that generates heat by current supplied from the electrode and is formed into a substantially semicircular shape. Accordingly, it is possible to heat the fixing belt directly by the planar heat generating element without interposing an extra substrate and to provide the heating member having excellent heat transmission efficiency. In addition, the planar heat generating element has a coat layer capable of reducing a frictional force between the fixing belt and the heating member on a surface in the side in contact with the fixing belt. Accordingly, it is possible to maintain high durability of the fixing belt that is in contact with the planar heat generating element to slide.

Further, the invention also provides an image forming apparatus including the fixing device mentioned above.

According to the invention, an image forming apparatus includes the fixing device capable of uniforming distribution of a temperature in the longitudinal direction of the heating member and of attaining uniform fixing capability in the fixing nip region. Accordingly, the image forming apparatus is capable of causing the recording medium to pass through the fixing nip region in a state where variance of a toner fixing temperature is prevented and forming an image having high printing quality.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
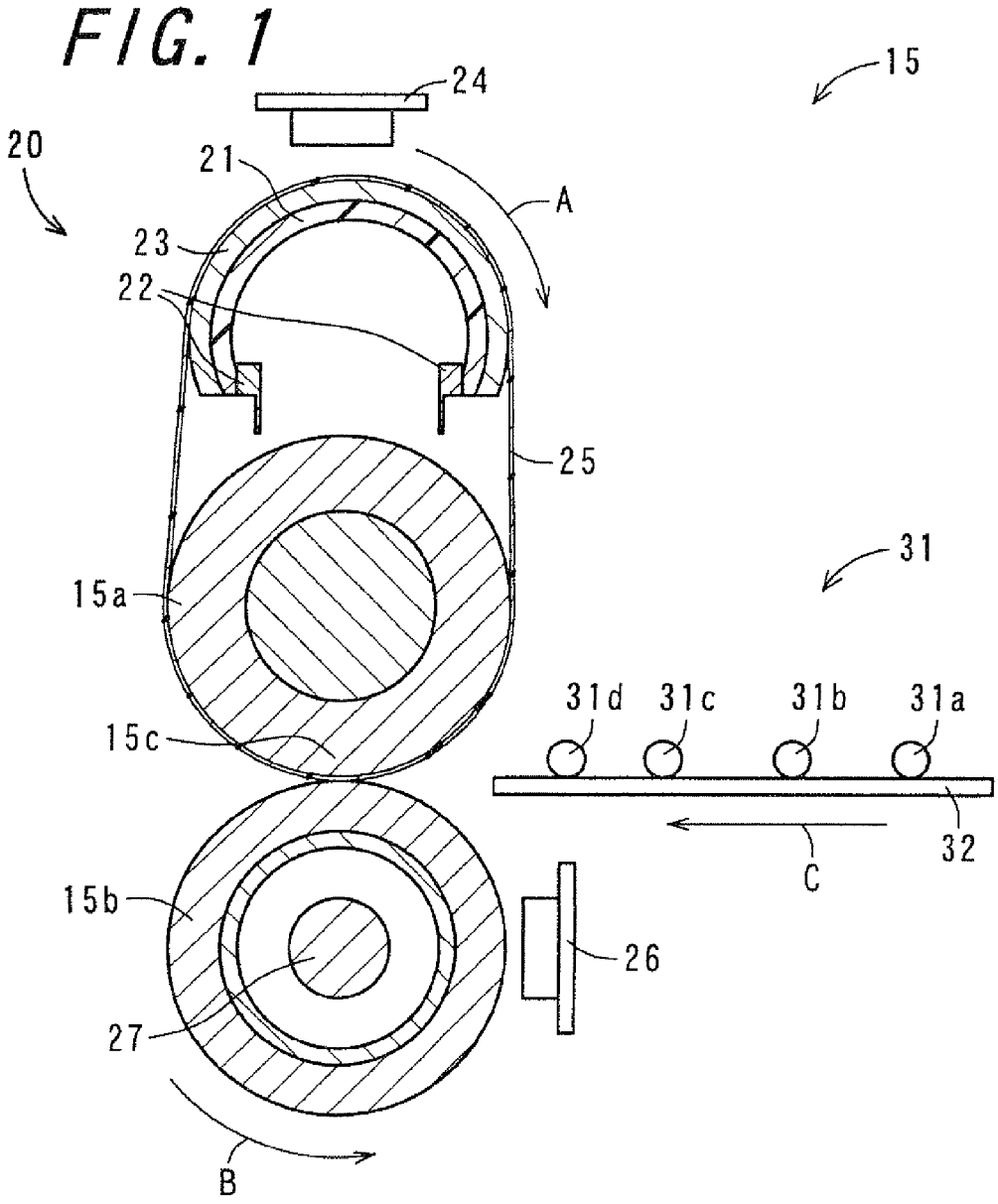
FIG. 1 is a view showing the structure of a fixing device according to a first embodiment of the invention.

Now referring to the drawings, preferred embodiments of the invention are described below.

FIG. 1 is a view showing the structure of a fixing device 15 according to a first embodiment of the invention. The fixing device 15 includes a fixing roller 15*a*, a pressure roller 15*b*, a fixing belt 25, and a heating member 20. In the fixing device 15, the fixing belt 25 is supported around the fixing roller 15*a* and the heating member 20 with tension, and the pressure roller 15*b* is disposed so as to face the fixing roller 15*a* with the fixing belt 25 interposed therebetween. The fixing roller 15*a* and the heating member 20 are disposed so as to be substantially in parallel to each other in an axial direction of the fixing roller 15*a*. Accordingly, when the fixing belt 25 supported around the fixing roller 15*a* and the heating member 20 with tension is slid, it is possible to prevent meandering and maintain high durability of the fixing belt 25.

The fixing device 15 is a device in which the heating member 20 is in contact with the fixing belt 25 to heat the fixing belt 25, and when a recording sheet 32 as a recording medium passes through a fixing nip region 15*c* formed by the fixing belt 25 and the pressure roller 15*b* at a predetermined fixing speed (220 mm/sec in this embodiment) and a copying speed, a toner image 31 borne on the recording sheet 32 is heated and pressurized to be fixed on the recording sheet 32. Note that, the fixing speed means a so-called process speed, and the copying speed means the number of copies per minute. Moreover, when the recording sheet 32 passes through the fixing nip region 15*c*, the fixing belt 25 abuts against a surface opposite to a toner image bearing surface of the recording sheet 32.

The fixing roller 15*a* is brought into pressure-contact with the pressure roller 15*b* with the fixing belt 25 interposed therebetween to thereby form the fixing nip region 15*c*, and at the same time, is rotated in a rotational direction A around a rotational axis by a note shown driving motor (driving section) to thereby cause the fixing belt 25 to run. The fixing roller 15*a* has a diameter of 30 mm and has a two-layer structure consisting of a core metal and an elastic layer, which are arranged in this order from inside, and as the core metal, for example, a metal such as iron, stainless steel, aluminum, and copper, an alloy thereof, or the like are used. Moreover, for the elastic layer, a rubber material having heat resistance such as silicone rubber and fluorine rubber is suitable. Note that, in this embodiment, a force when the fixing roller 15*a* is brought into pressure-contact with the pressure roller 15*b* with the fixing belt 25 interposed therebetween is about 216 N.

The pressure roller 15*b* is provided so as to face and be brought into pressure-contact with the fixing roller 15*a* with the fixing belt 25 interposed therebetween and to rotate freely around a rotational axis. The pressure roller 15*b* is rotated by rotation of the fixing roller 15*a* and rotates in a rotational direction B. The pressure roller 15*b* has a three-layer structure consisting of a core metal, an elastic layer, and a release layer, which are arranged in this order from inside. For the core metal, for example, a metal such as iron, stainless steel, aluminum, and copper, an alloy thereof, or the like is used. Moreover, suitable for the elastic layer is a rubber material having heat resistance such as silicone rubber and fluorine rubber, and suitable for the release layer is a fluorine resin such as PFA (copolymer of tetrafluoroethylene and perfluoroalkylvinylether) and PTFE (polytetrafluoroethylene). Moreover, disposed inside the pressure roller 15*b* is a heater lamp 27 for heating the pressure roller 15*b*. When a control circuit (not shown) supplies an electric power (electrifies) from a power source circuit (not shown) to the heater lamp 27, the heater lamp 27 emits light and radiates infrared rays. Whereby, an inner circumferential surface of the pressure roller 15*b* absorbs the infrared rays to be heated and the pressure roller 15*b* is entirely heated.

The fixing belt 25 is heated to a predetermined temperature by the heating member 20 and heats the recording sheet 32 having the unfixed toner image 31 formed thereon that passes through the fixing nip region 15*c*. The fixing belt 25 is an endless belt having a diameter of 45 mm and is set around the heating member 20 and the fixing roller 15*a* and wound up by the fixing roller 15*a* with a predetermined angle. During rotation of the fixing roller 15*a*, the fixing belt 25 is driven by the fixing roller 15*a* and rotates in the rotational direction A. The fixing belt 25 has a three-layer structure consisting of a hollow cylindrical substrate made of a heat resistant resin such as polyimide or a metal material such as stainless steel and nickel; an elastic layer formed on the substrate and made of an elastomer material having excellent heat resistance and elastic property (for example, silicone rubber); and a release layer formed on a surface of the elastic layer and made of a synthetic resin material having excellent heat resistance and releasing property (for example, a fluorine resin such as PFA or PTFE). Moreover, a fluorine resin may be added into polyimide of the substrate. This makes it possible to reduce a slide load with the heating member 20.

Figure 2A:
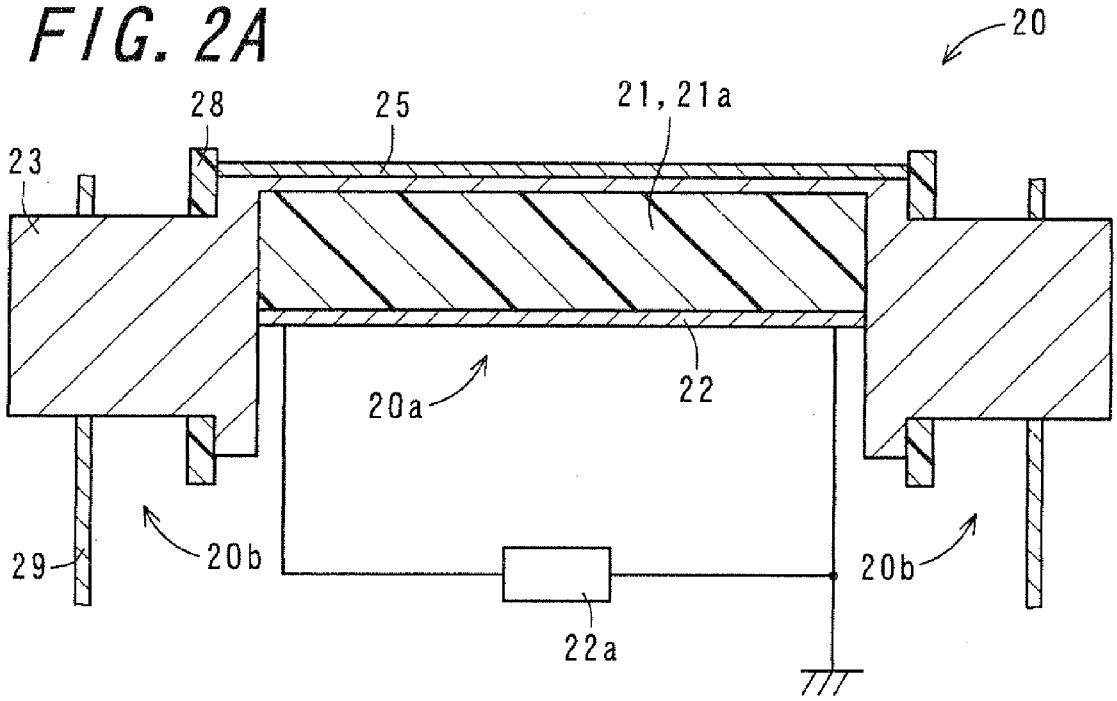
FIGS. 2A and 2B are views showing the structure of a heating member provided in the fixing device.
Figure 2B:
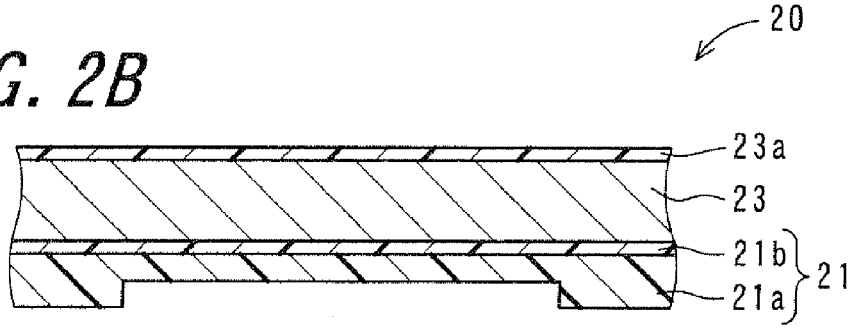
Figure 3:
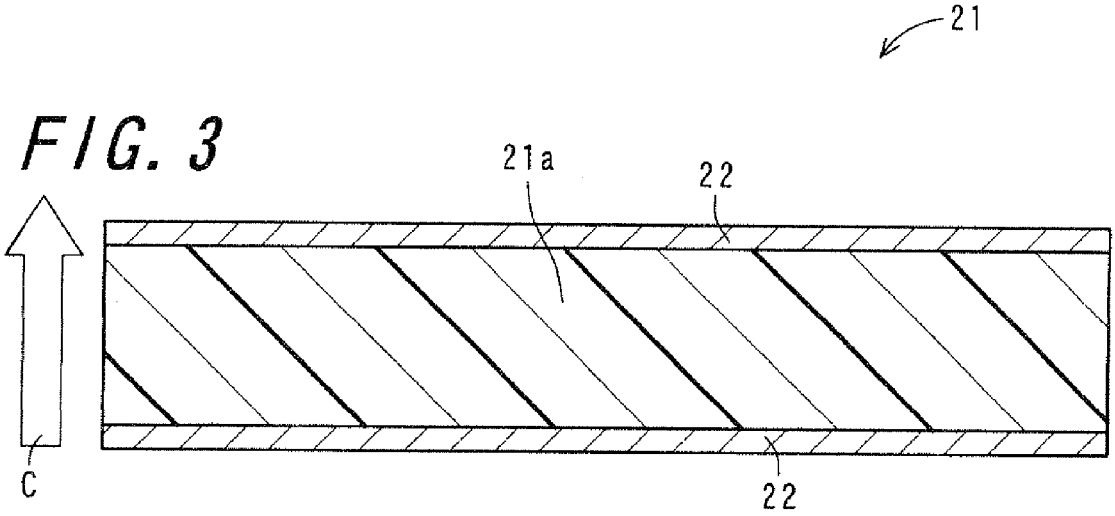
FIG. 3 is a developed view of a planar heat generating element provided in the heating member.

FIGS. 2A and 2B are views showing the structure of the heating member 20 provided in the fixing device 15. Moreover, FIG. 3 is a developed view of a planar heat generating element 21 provided in the heating member 20. The heating member 20 is a member that is in contact with the fixing belt 25 to heat the fixing belt 25 to a predetermined temperature. The heating member 20 includes a substrate 23 and the planar heat generating element 21.

The substrate 23 has a hollow roll shape including a body section 20*a* and a journal section 20*b*, and the body section 20*a* has a substantially semicircular cross section having a cut-out portion whose lower half part is cut off. The body section 20*a* is a part being in contact with the fixing belt 25 and serves as a heat generating section for generating heat, in which the planar heat generating element 21 described below is disposed. The journal section 20*b* is a part formed on both ends of the body section 20*a*, and is fixed to a side frame 29 of the fixing device 15 so that the heating member 20 itself does not rotate with a frictional force between the fixing belt 25 and the heating member 20. In this way, since the heating member 20 itself is constituted so as not to rotate, it is possible to secure safety sufficiently, even when high current is supplied to the planar heat generating element 21 described below at the time of heat generation from the planar heat generating element 21.

Further, the journal section 20*b* is formed with a meandering prevention collar 28 that prevents meandering when the fixing belt 25 rotates and slides, so as to be in contact with an end of the fixing belt 25. Note that, as the meandering prevention collar 28, a collar made of polyphenylene sulfide (PPS) is usable, but not limited thereto as far as having a structure capable of rotating independently from the heating member 20. In this way, since the meandering prevention collar 28 rotates freely and independently, the fixing belt 25 is not applied with a load and does not slide when abutting against the meandering prevention collar 28, and the fixing belt 25 is prevented from being broken, thus making it possible to maintain high durability of the fixing belt 25.

The planar heat generating element 21 is formed extending in parallel with the axial direction of the fixing roller 15*a* so as to be along a surface of the body section 20*a*. Further, the planar heat generating element 21 is formed with electrodes 22 at both ends in a circumferential direction which is a direction extending in parallel with the axial direction of the fixing roller 15*a*. In addition, when current is supplied from an AC power source 22*a* connected to the electrodes 22, the planar heat generating element 21 has positive resistance temperature characteristic to generate heat. At this time, a flowing direction of the current flowing through the planar heat generating element 21 is a direction substantially orthogonal to a longitudinal direction in the planar heat generating element 21. Here, the positive resistance temperature characteristic refers to a characteristic showing sudden rise in electric resistance at a predetermined temperature, in which, even when the temperature tends to rise, the current is suppressed by rise in the electric resistance and more excess rise is capable of being suppressed.

In this embodiment, by applying voltage of AC 100V to the electrodes 22 from the AC power source 22*a*, the planar heat generating element 21 generates a thermal energy of about 1000 W to generate heat and heats the fixing belt 25 with the generated heat. In this way, since the planar heat generating element 21 directly generates heat and heats the fixing belt 25, a thermal response speed is enhanced compared to a conventional system in which a fixing roller having a heating section such as a halogen lamp inside thereof heats a recording sheet passing through a fixing nip region, and it is possible to attain shortening of a time for warm up and power saving.

Moreover, in the fixing device 15, as a temperature detecting section, a thermistor on the heat generating element side 24 is disposed on a circumferential surface of the fixing belt 25 and a thermistor on the pressure roller side 26 is disposed on a circumferential surface of the pressure roller 15*b*, so that respective surface temperatures are detected. In addition, based on temperature data detected by each of the thermistors 24 and 26, a control circuit (not shown) as a temperature control section controls fed power (electrification) to the planar heat generating element 21 and the heater lamp 27 so that the fixing belt 25 and the pressure roller 15*b* have the predetermined surface temperatures.

Next, a layer structure in the body section 20*a* as a heating section of the heating member 20 will be described with reference to FIG. 2B. The layer structure in the body section 20*a* of the heating member 20 has a four-layer structure consisting of a heat generating layer 21*a*, an insulating layer 21*b*, the substrate 23, and a coat layer 23*a*, which layers are arranged in this order from inside to the side being in contact with the fixing belt 25. The heat generating layer 21*a* and the insulating layer 21*b* constitute the planar heat generating element 21.

The heat generating layer 21*a* of the planar heat generating element 21 is a layer that generates heat when voltage is applied from the AC power source 22*a* to the electrodes 22. In addition, the heat generating layer 21*a* is formed so as to have a flat surface facing the substrate 23 with the insulating layer 21*b* described below interposed therebetween and a surface opposite, thereto in which both ends in a longitudinal direction thereof are inwardly projected. In this way, the heat generating layer 21*a* is constituted so that the both ends in the longitudinal direction thereof have larger thickness than that of a center part thereof.

The heat generating layer 21*a* needs to heat the fixing belt 25 to a temperature of about 200° C. in order to secure fixing performance. Therefore, it is necessary that a material constituting the heat generating layer 21*a* has high heat resistance, and in this embodiment, the heat generating layer 21*a* is made of a composite material in which heat-resistant polymer of an organic material or an organic and inorganic composite is filled with a conductive filler.

Examples of the heat-resistant polymer include a polyimide resin, a polyphenylene oxide resin, a polyphenylene sulfide resin, a syndiotactic polystyrene resin, a crystalline polyester resin, a polyether ether ketone resin, an epoxy resin, and a silicone resin. Moreover, the positive resistance temperature characteristic of the planar heat generating element 21 is realized by glass transition or crystal transition of the heat-resistant polymer.

The heat generating layer 21*a* preferably uses a relatively inexpensive material that has a high impedance and is easily handled in terms of an electric circuit, in addition, that is easily formed on the surface of the body section 20*a* having a substantially semicircular shape, thus the heat-resistant polymer is filed with a conductive filler. Used as the conductive filler is metal, carbon, oxide, carbide, and nitride particle, and an example thereof includes a conductive particle such as nickel, copper, tungsten, titanium, silver, gold, aluminum, activated carbon, graphite, graphite, tin oxide, indium oxide, vanadium oxide, rhenium oxide, silicon carbide, titanium nitride, $TiB_2$, $ZrB_2$, $WSi_2$, TiC, and $TiO_2$.

The conductive particle preferably has a size within a range of 0.1 to 100 μm. The particle of less than 0.1 μm is very fine and it is difficult to disperse uniformly. It is difficult to disperse the particle exceeding 100 μm uniformly and to adjust an electric resistance value. In addition, the conductive particle is preferably included at a ratio of 10 to 70% by volume. In the case of less than 10% by volume, conductivity is not shown. On the other hand, in the case of exceeding 70% by volume, it is difficult to sufficiently include heat-resistance polymer as base polymer between particles and it is impossible to maintain the layer shape of the heat generating layer 21*a*.

In addition, in order to enhance durability of heat-resistance polymer at a high temperature, it is possible to add curing agents. The curing agents are selected depending on a kind of the heat-resistance polymer, and an example thereof includes a commonly used curing agent such as polyisocyanate, aliphatic or aromatic polyamine, thiourea, and acid anhydride.

The insulating layer 21*b* of the planar heat generating element 21 is a layer that secures insulation between the substrate 23 described below and the heat generating layer 21*a*. In this way, the insulating layer 21*b* is formed, whereby it is possible to provide the safer, heating member. An example of a material constituting the insulating layer 21*b* includes the heat-resistance polymer used for the heat generating layer 21*a* described above, and a polyimide resin is selected in this embodiment.

The body section 20*a* of the substrate 23 is a part for transmitting heat generated by the heat generating layer 21*a* of the planar heat generating element 21 to the fixing belt 25. Therefore, it is necessary to form the substrate 23 of a material having high thermal conductivity. An example of the material constituting the substrate 23 includes a metal such as aluminum.

The coat layer 23*a* is an outermost layer in the body section 20*a* of the heating member 20 and is a layer in contact with the fixing belt 25. Therefore, it is necessary to make the coat layer 23*a* of a material having heat transmission performance for transmitting, to the fixing belt 25, heat transferred from the heat generating layer 21*a* to the substrate 23 as well as capable of reducing a frictional force between the fixing belt 25 and the heating member 20. The coat layer 23*a* is formed in this way, whereby it is possible to transfer heat to the fixing belt 25 and to maintain high durability of the fixing belt 25 that is in contact with the heating member 20 to slide. An example of the material constituting the coat layer 23*a* includes a fluorine resin such as PFA or PTFE, and a reinforcing filler such as carbon may be filled in order to realize high strength.

Note that, a method for producing the laminate structure including four layers above in the body section 20*a* of the heating member 20 is usable by appropriately selecting a method commonly used in this field.

In the heating member 20 having the planar heat generating element 21 as described above, particularly when heat capacity of the planar heat generating element 21 is reduced to shorten a temperature rising rate, the influence of heat radiation from both ends in a longitudinal direction of the planar heat generating element 21 becomes large. Accordingly, in order to uniform distribution of a temperature in the longitudinal direction of the planar heat generating element 21, it is necessary to control distribution of heat radiation volume in the longitudinal surface of the planar heat generating element 21. It is possible to control such distribution of heat radiation volume by making electric resistance distribution in the longitudinal surface of the planar heat generating element 21 to form distribution of a current value.

Figure 4A:
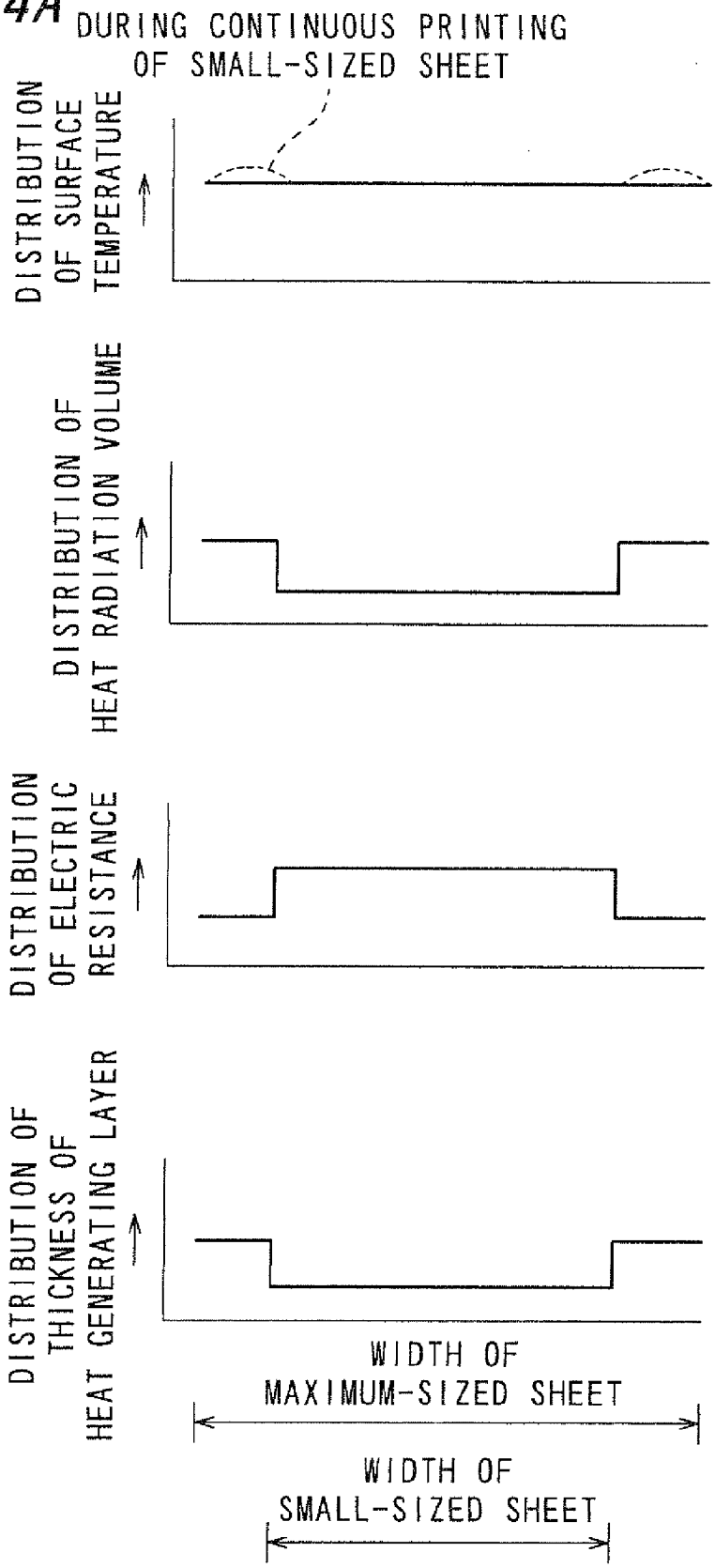
FIGS. 4A to C are views showing distribution of a temperature, distribution of heat radiation volume, distribution of electric resistance, and distribution of thickness with respect to a length from one end in a longitudinal direction in a heat generating layer provided in the planar heat generating element.
Figure 4B:
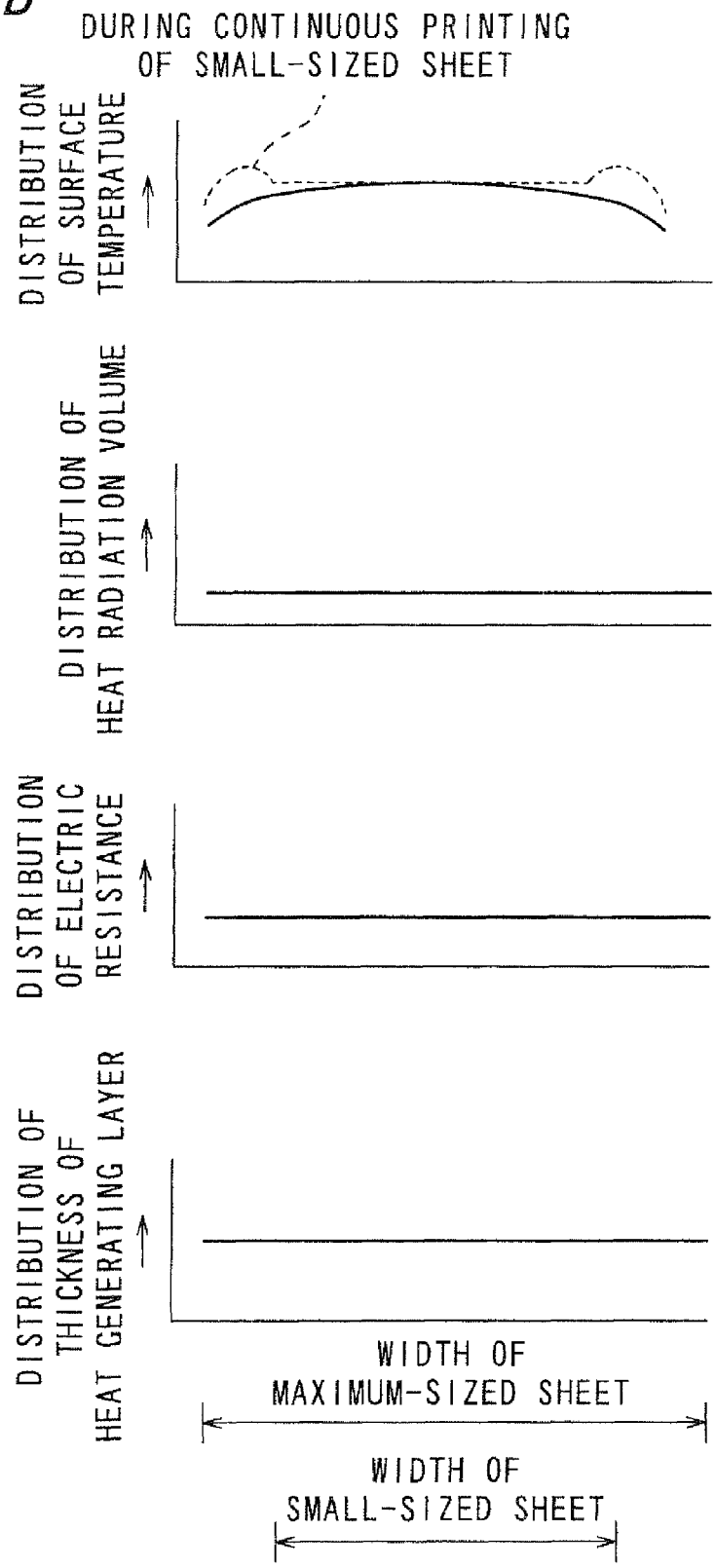
FIG. 4B PRIOR ART
Figure 4C:
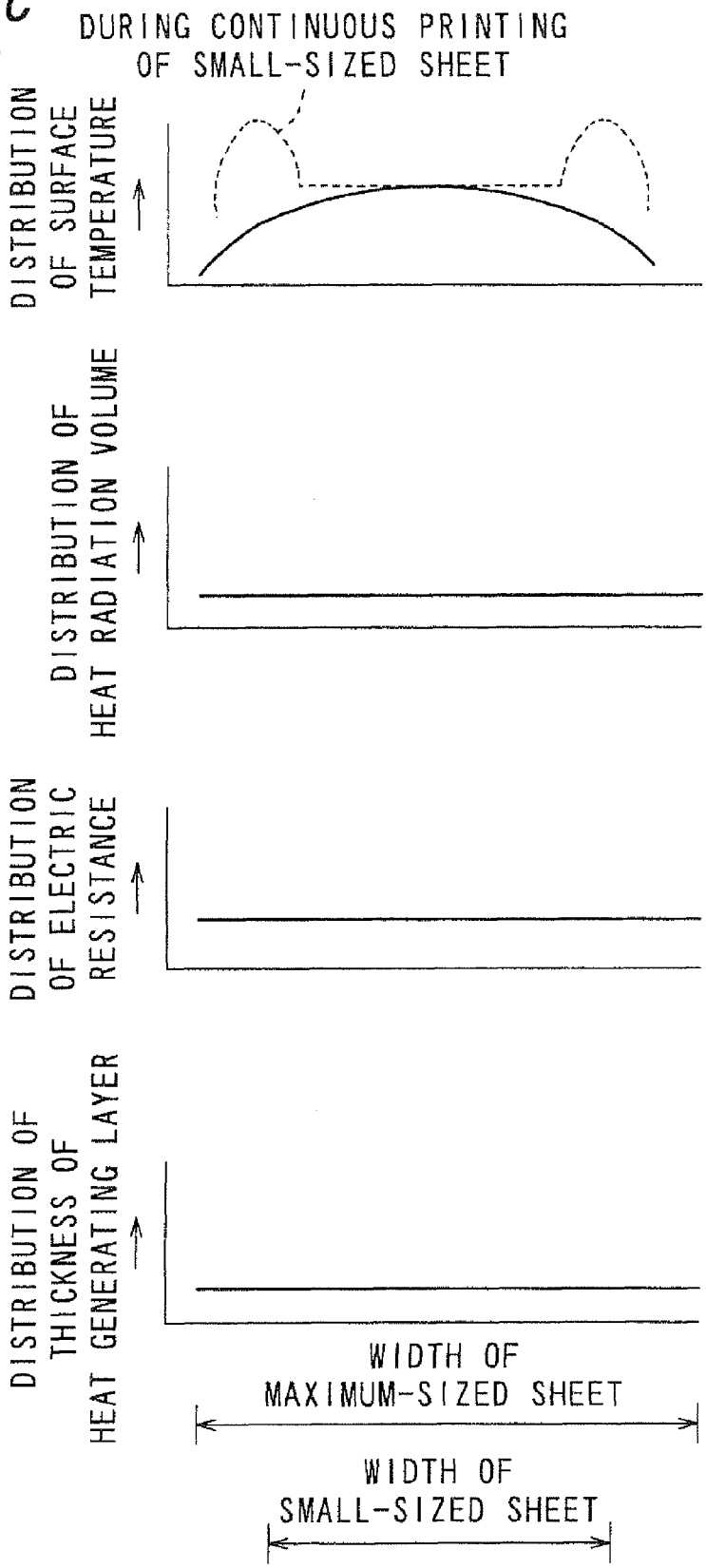
FIG. 4C PRIOR ART
Figure 5:
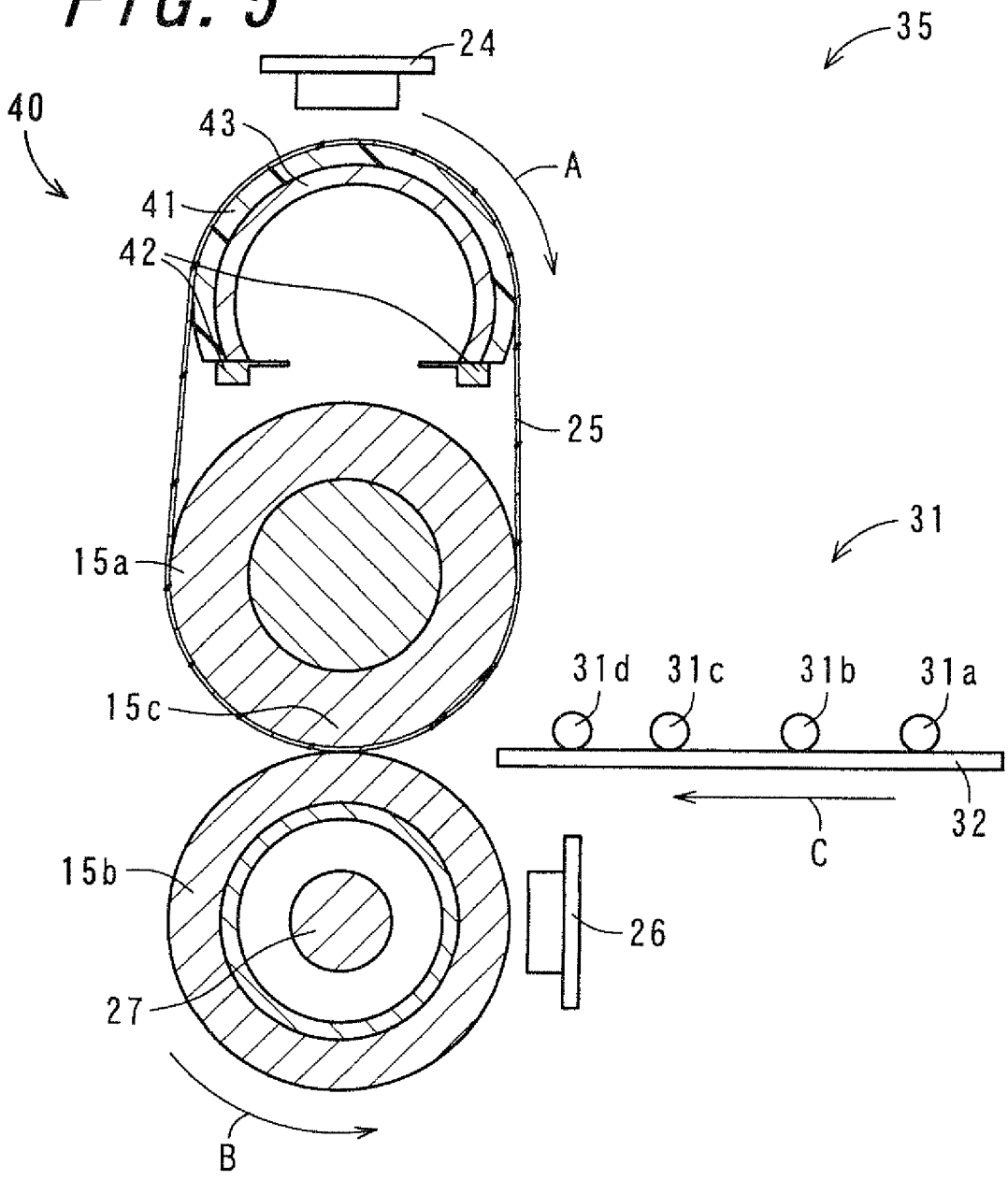
FIG. 5 is a view showing the structure of a fixing device according to a second embodiment of the invention.

FIGS. 4A to 4C are views showing distribution of a temperature, distribution of heat radiation volume, distribution of electric resistance, and distribution of thickness with respect to a length from one end in a longitudinal direction in the heat generating layer provided in the planar heat generating element. FIG. 4A shows behavior in the heat generating layer 21*a* provided in the planar heat generating element 21 according to an embodiment of the invention.

The planar heat generating element 21 provided in the heating member 20 is constituted so that both ends in a longitudinal direction of the heat generating layer 21*a* have larger thickness than that of a center part thereof. At this time, a flowing direction of current is a direction substantially orthogonal to the longitudinal direction of the heat generating layer 21*a* as described above, thus an area of the both ends in the longitudinal direction of the heat generating layer 21*a* and an area of the center part thereof are electrified as a parallel connection circuit and are therefore applied with the same voltage. In such a state, the heat generating layer 21*a* is configured so that the both ends in the longitudinal direction of the heat generating layer 21*a* have larger thickness than that of the center part thereof to control distribution of electric resistance and distribution of a current value and suppress loss in heat radiation from the both ends in the longitudinal direction thereof.

That is, the heat generating layer 21*a* provided in the planar heat generating element 21 is configured so that the both ends in the longitudinal direction thereof have larger thickness than that of the center part thereof to thereby lower the electric resistance value of the both ends in the longitudinal direction of the planar heat generating element 21 and increase the current amount, thus making it possible to increase the heat radiation volume in the both ends in the longitudinal direction thereof. Accordingly, it is possible to compensate loss in heat radiation from the both ends in the longitudinal direction of the planar heat generating element 21 with the increased heat radiation volume and to uniform distribution of a temperature in the longitudinal direction of the planar heat generating element 21, thus uniform fixing capability in the fixing nip region 15*c* is attained and it is possible to suppress generation of offset and to form an image having high printing quality.

Moreover, when recording sheets 32 having different sizes continuously pass through, although a temperature of an area of a non-sheet passing end increases, the planar heat generating element 21 exhibits the positive resistance temperature characteristic in a state where current flows in a direction orthogonal to the longitudinal direction of the planar heat generating element 21 (conveyance direction of the recording sheets 32), thus the current of that part is suppressed by rise in electric resistance and more excessive rise in temperature is capable of being suppressed.

In this embodiment, thickness in the longitudinal direction of the heat generating layer 21*a* provided in the planar heat generating element 21 is set so that thickness of the both ends becomes larger at a rate of 5 to 30% relative to that of the center part. In the case of being smaller than 5%, an effect of reducing the electric resistance value in the both ends to increase heat radiation volume is not obtained. In addition, in the case of being larger than 30%, the electric resistance value in the both ends is excessively lowered to increase the heat radiation volume more than needs.

Moreover, in the heat generating layer 21*a*, a length of the center part in the longitudinal direction with smaller thickness is preferably set to be shorter than the maximum width of the recording sheet 32 that passes through the fixing nip region 15*c*. Whereby, the both ends of the planar heat generating element 21 having large thickness and are capable of setting large heat radiation volume will not be disposed outside an end in the longitudinal direction of the recording sheet 32. Thus, the recording sheet 32 that passes through the fixing nip region 15*c* is in contact with the fixing belt 25 that has large heat radiation volume at both ends in a width direction of the recording sheet 32. Accordingly, in a state where there is no temperature difference between the both ends and the center part while loss in heat radiation at the both ends in the longitudinal direction thereof being suppressed and distribution of a temperature is uniformed across the entire area in the longitudinal direction, the recording sheet 32 passes through the fixing nip region 15*c*, thus the toner image 31 is uniformly fixed.

Further, by reducing the longitudinal length of the area of the both ends as much as possible in a state where the both ends in the longitudinal direction of the planar heat generating element 21 having large thickness are not disposed outside the end in the longitudinal direction of the recording sheet 32, it is possible to reduce heat capacity, which shortens a time for warm up, thus making it possible to perform image formation onto the recoding sheet 32 in a state of power saving with small power consumption and to miniaturize the apparatus.

On the other hand, FIGS. 4B and 4C show behavior in a heat generating layer provided in a planar heat generating element of a conventional technology. First, FIG. 4B shows behavior in a heat generating layer that has constant distribution of thickness in a longitudinal direction and a positive resistance temperature characteristic. Since distribution of thickness in the longitudinal direction of the heat generating layer is constant, being influenced by loss in heat radiation from both ends in a longitudinal direction thereof, a temperature is being low at an area of the both ends although the heat generating layer has the positive resistance temperature characteristic. Also during continuous printing of small-sized sheets, decrease in the temperature of the both ends is inevitable.

Next, FIG. 4C shows behavior in a heat generating layer that has constant distribution of thickness in a longitudinal direction and no positive resistance temperature characteristic. In such a heat generating layer, the influence of loss in heat radiation from both ends in a longitudinal direction of the heat generating layer is large and temperature distribution in a drum shape, in which a center part of the heat generating layer has a high temperature, is shown. Further, in the case of continuous printing of small-sized sheets, the both ends can not supply heat to the sheets, thus the heat is accumulated to cause overheated state.

Figure 6:
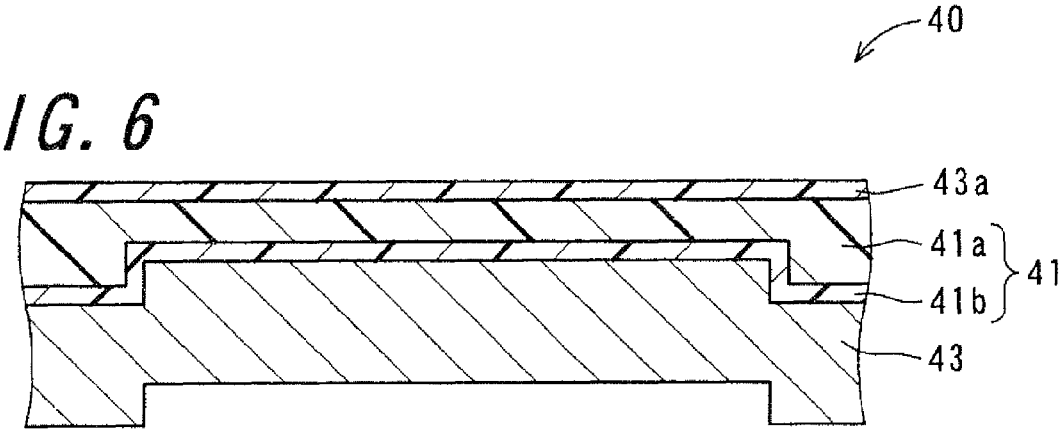
FIG. 6 is a view showing the structure of a heating member provided in the fixing device.

FIG. 3 is a view showing the structure of a fixing device 35 according to a second embodiment of the invention. In addition, FIG. 6 is a view showing the structure of a heating member 40 provided in the fixing device 35. The fixing device 35 is similar to the above-described fixing device 15, and corresponding parts will be denoted by the same reference numerals and a description thereof will be omitted. In the fixing device 35, a body section of a substrate 43 provided in the heating member 40 has a different layer structure from the heating member 20 of the fixing device 15.

The layer structure of the body section as a heating section of the heating member 40 of the fixing device 35 will be described with reference to FIG. 6. The layer structure of the body section of the heating member 40 has a four-layer structure consisting of the substrate 43, an insulating layer 41*b*, a heat generating layer 41*a* and a coat layer 43*a*, which layers are arranged in this order from inside to the side being in contact with the fixing belt 25. The insulating layer 41*b* and the heat generating layer 41*a* constitute the planar heat generating element 41.

In the heating section of the heating member 40, the insulating layer 41*b* is formed on an outer circumferential surface of the substrate 43 in which steps are provided on both ends thereof, and on the outer surface thereof, the heat generating layer 41*a* is formed so that both ends in a longitudinal direction thereof have larger thickness than that of a center part thereof. At this time, the surface of the heat generating layer 41*a*, facing the fixing belt 25 with the coat layer 43*a* interposed therebetween, is formed flat. In addition, the coat layer 43*a* is formed on the outermost layer being in contact with the fixing belt 25.

The fixing device 35 having the structure as described above suppresses loss in heat radiation from the both ends in the longitudinal direction of the planer heat generating element 41 so as to be able to uniform distribution of a temperature in the longitudinal direction of the planar heat generating element 41 and is able to attain uniform fixing capability in a fixing nip region 15*c*, similarly to the fixing device 15.

Figure 7:
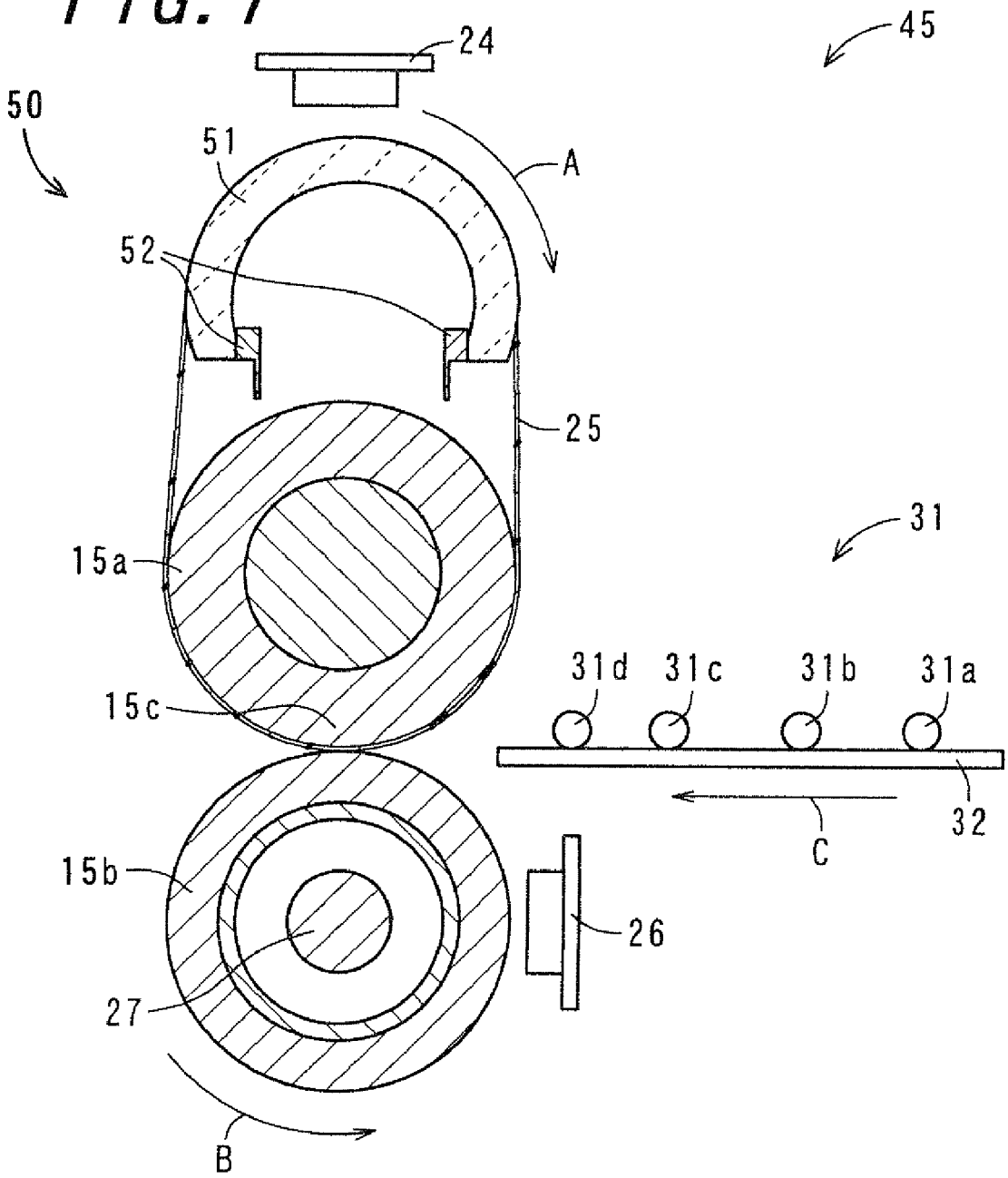
FIG. 7 is a view showing the structure of a fixing device according to a third embodiment of the invention.
Figure 8:
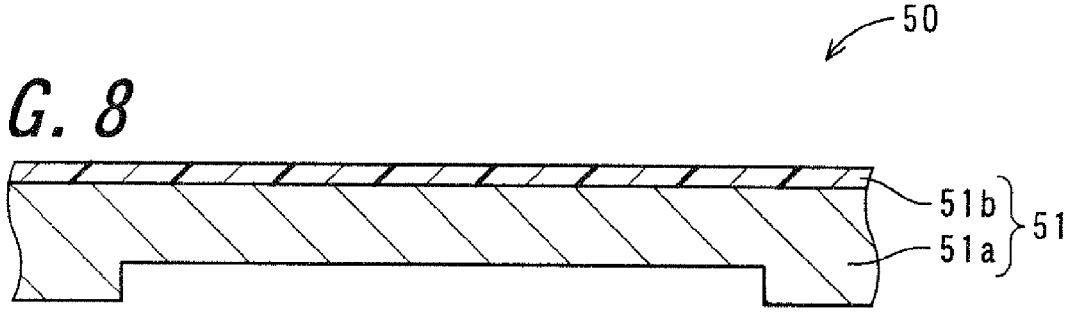
FIG. 8 is a view showing the structure of a heating member provided in the fixing device.

FIG. 7 is a view showing the structure of a fixing device 45 according to a third embodiment of the invention. In addition, FIG. 8 is a view showing the structure of a heating member 50 provided in the fixing device 45. The fixing device 45 is similar to the above-described fixing device 15, and corresponding parts will be denoted by the same reference numerals and a description thereof will be omitted. In the fixing device 45, the heating member 50 has a different structure from the heating member 20 of the fixing device 15.

The structure of a heating section of the heating member 50 provided in the fixing device 45 will be described with reference to FIG. 8. The heating section of the heating member 50 is constituted only by a planar heat generating element 51 having a heat generating layer 51*a* and formed into a substantially semicircular shape. That is, the heating member 50 has no substrate provided in the heating member 20. Whereby, it is possible to directly heat a fixing belt 25 by the planar heat generating element 51 without interposing an extra substrate, which enables the heating member to have excellent heat transmission efficiency.

Moreover, the heat generating layer 51*a* is formed so that both ends in the longitudinal direction thereof have larger thickness than that of a center part thereof. At this time, in the heat generating layer 51*a*, the surface facing the fixing belt 25 with a coat layer 51*b* interposed therebetween is formed flat and the surface opposite thereto is formed so as to project inward in the both ends. Therefore, loss in heat radiation from the both ends in the longitudinal direction of the planar heat generating element 51 is suppressed so as to be able to uniform distribution of a temperature in the longitudinal direction of the planar heat generating element 31 and to attain uniform fixing capability in a fixing nip region 15*c*.

In addition, the planar heat generating element 51 is provided with the coat layer 51*b* on the surface in the side in contact with the fixing belt 25. Whereby, it is possible to maintain high durability of the fixing belt 25 that is in contact with the heating member 50 to slide.

The planar heat generating element 51 of the heating member 50 as described above is preferably constituted by semiconductor ceramics based on barium titanate. A material having a positive resistance temperature characteristic based on barium titanate transfers from semiconductive property to insulating property. That is, as the crystal structure is subjected to phase change from a tetragonal system to a cubic system, spontaneous polarizations dissipate and domains are also eliminated, thus showing the positive resistance temperature characteristic.

Moreover, in the fixing device 45, a non-conductive member such as a ceramic insulator is preferably disposed in bearing sections at both ends of the heating member 50. Whereby, it is possible to secure insulating property to thereby secure safety.

Figure 9:
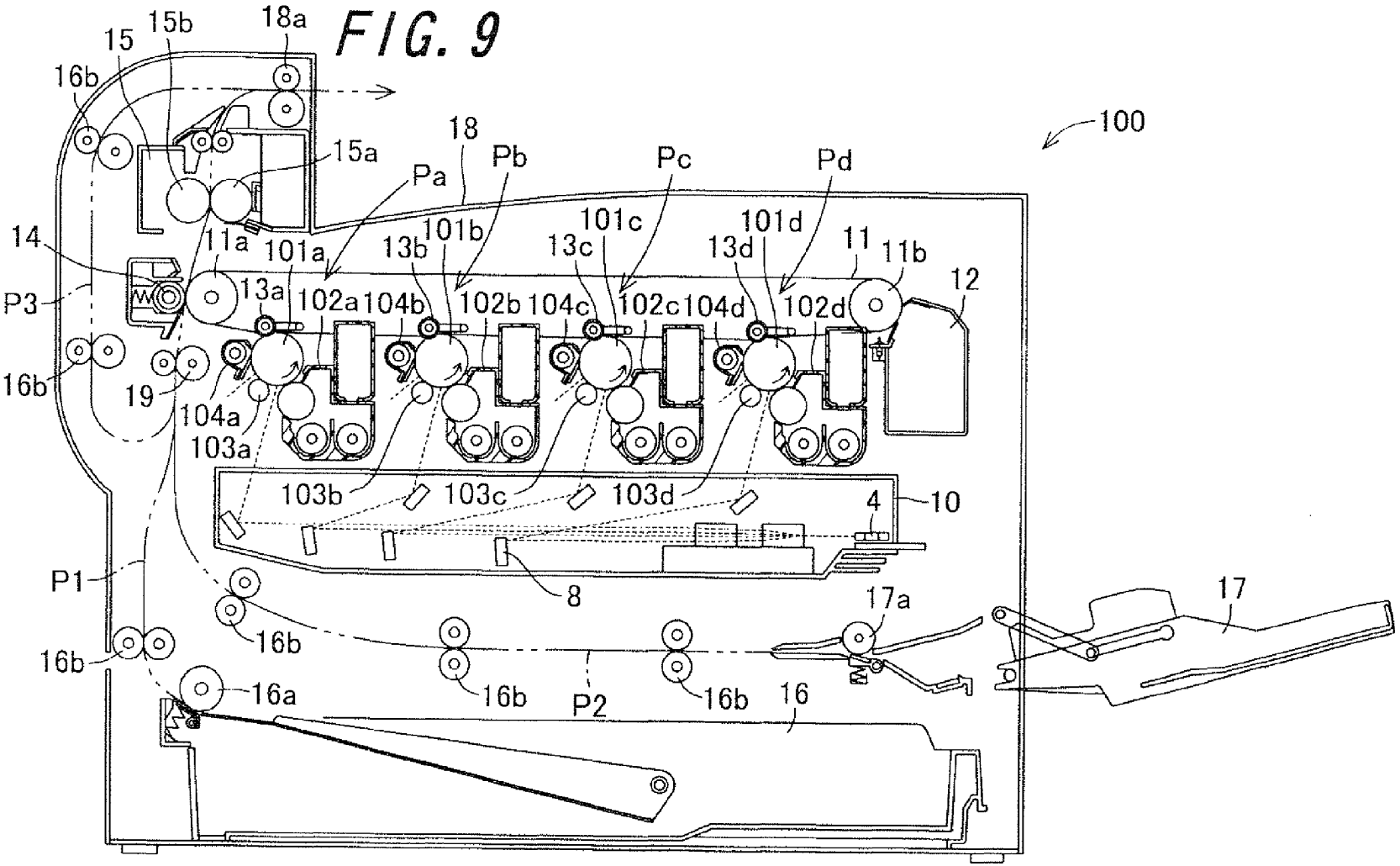
FIG. 9 is a view showing the structure of an image forming apparatus according to an embodiment of the invention.
Figure 10A:
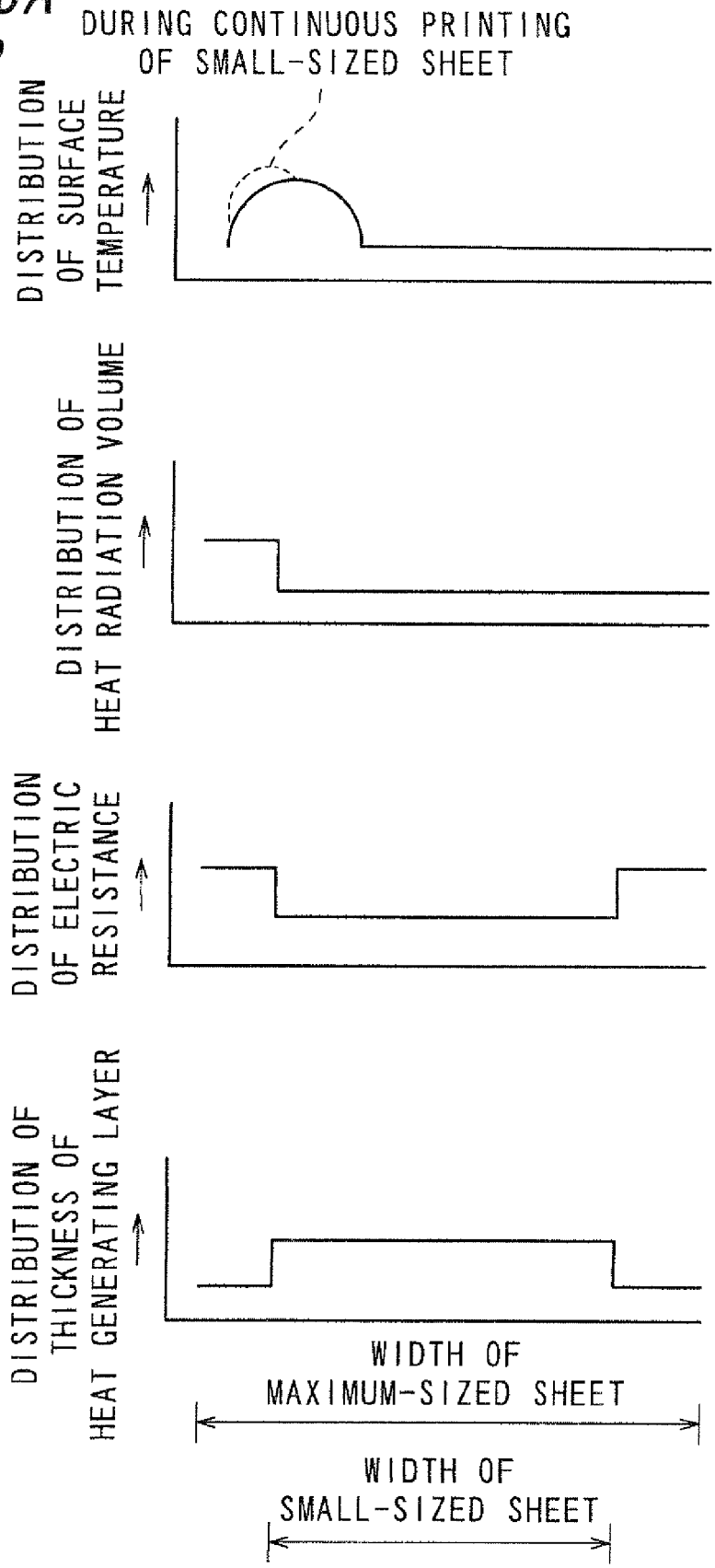
FIG. 10A PRIOR ART
FIGS. 10A and 10B are views showing distribution of a temperature, distribution of heat radiation volume, distribution of electric resistance, and distribution of thickness with respect to a length from an end in a longitudinal direction in the heat generating layer provided in the planar heat generating element in the DH fixing systems.
Figure 10B:
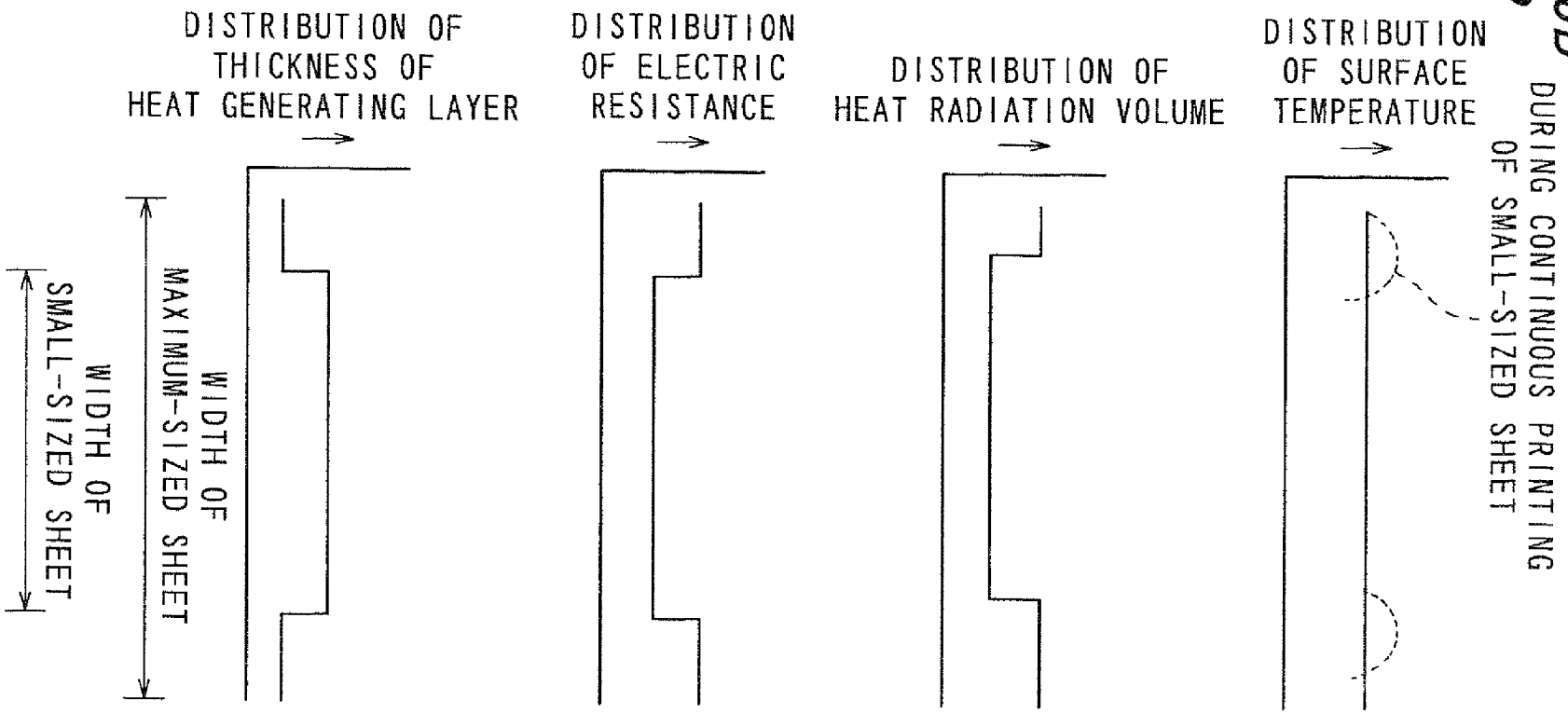
FIG. 10B PRIOR ART

FIG. 9 is a view showing the structure of an image forming apparatus 100 according to an embodiment of the invention. The image forming apparatus 100 is an apparatus that forms a color or monochrome image on a recording sheet based on image data read from a document or on image data transmitted through a network and the like. The image forming apparatus 100 includes an exposure unit 10, photoreceptor drums 101 (101*a* to 101*d*), developing devices 102 (102*a* to 102*d*), charging rollers 103 (103*a* to 103*d*), cleaning units 104 (104*a* to 104*d*), an intermediate transfer belt 11, primary transfer rollers 13 (13*a* to 13*d*), a secondary transfer roller 14, a fixing device 15, paper conveyance paths P1, P2, and P3, a paper feeding cassette 16, a manual paper feeding tray 17, and a catch tray 18.

The image forming apparatus 100 performs image formation by using image data corresponding to each of the four colors of black (k), as well as cyan (C), magenta (M), and yellow (Y), which are the three primary subtractive colors obtained by separating colors of a color image, in image forming sections Pa to Pd corresponding to the respective colors. The respective image forming sections Pa to Pd are similar to one another in configuration, and for example, the image forming section Pa for black (K) is constituted by the photoreceptor drum 101*a*, the developing device 102*a*, the charging roller 103*a*, the primary transfer roller 13*a*, the cleaning unit 104*a*, and the like. The image forming sections Pa to Pd are arranged in alignment along a direction in which the intermediate transfer belt 11 moves (sub-scanning direction).

The charging rollers 103 are contact-type charging devices for charging surfaces of the photoreceptor drums 101 uniformly to a predetermined potential. Instead of the charging rollers 103, contact-type charging devices using a charging brush, or noncontact-type charging devices using a charging wire is also usable.

The exposure unit 10 includes a semiconductor laser (not shown), a polygon mirror 4, a first reflection mirror 7, a second reflection mirror 8, and the like, and irradiates each of the photoreceptor drums 101*a* to 101*d* with each light beam such as a laser beam modulated according to image data of the respective colors of black (K), cyan (C), magenta (M), and yellow (Y). Each of the photoreceptor drums 101*a* to 101*d* forms an electrostatic latent image corresponding to the image data of the respective colors of black (K), cyan (C), magenta (M), and yellow (Y).

The developing devices 102 supply toner as developer to the surfaces of the photoreceptor drums 101 on which the electrostatic latent images are formed, to develop the electrostatic latent images to a toner image. The respective developing devices 102*a* to 102*d* contain toner of the respective colors of black (K), cyan (C), magenta (M), and yellow (Y), and visualize the electrostatic latent images of the respective colors formed on the respective photoreceptor drums 101*a* to 101*d* into toner images of the respective colors. The cleaning units 104 remove and collect residual toner on the surfaces of the photoreceptor drums 101 after development and image transfer.

The intermediate transfer belt 11 provided above the photoreceptor drums 101 is supported around a driving roller 11*a* and a driven roller 11*b* with tension, and forms a loop-shaped moving path. An outer circumferential surface of the intermediate transfer belt 11 faces the photoreceptor drum 101*d*, the photoreceptor drum 101*c*, the photoreceptor drum 101*b* and the photoreceptor drum 101*a* in this order. The primary transfer rollers 13*a* to 13*d* are disposed at positions facing the respective photoreceptor drums 101*a* to 101*d* across the intermediate transfer belt 11. The respective positions at which the intermediate transfer belt 11 faces the photoreceptor drums 101*a* to 101*d* are primary transfer positions. In addition, the intermediate transfer belt 11 is formed of a film having thickness of 100 to 150 μm.

A primary transfer bias having the opposite polarity to the polarity of the toner is applied by constant voltage control to the primary transfer rollers 13*a* to 13*d* in order to transfer the toner images borne on the surfaces of the photoreceptor drums 101*a* to 101*d* onto the intermediate transfer belt 11. Thus, the toner images of the respective colors formed on the photoreceptor drums 101*a* to 101*d* are transferred and overlapped onto the outer circumferential surface of the intermediate transfer belt 11 sequentially to form a full-color toner image on the outer circumferential surface of the intermediate transfer belt 11.

However, when image data for only a part of the colors of yellow (Y), magenta (M), cyan (C) and black (B) is inputted, electrostatic latent images and toner images are formed at only a part of the photoreceptor drums 101 corresponding to the colors of the inputted image data among the four photoreceptor drums 101*a* to 101*d*. For example, during monochrome image formation, an electrostatic latent image and a toner image are formed only at the photoreceptor drum 101*a* corresponding to black color, and only a black toner image is transferred onto the outer circumferential surface of the intermediate transfer belt 11.

The respective primary transfer rollers 13*a* to 13*d* have a structure comprising a shaft having a diameter of 8 to 10 mm, made of a metal such as stainless steel and serving as a substrate, and a conductive elastic material (for example, EPDM or urethane foam) with which a surface of the shaft is coated, and uniformly apply a high voltage to the intermediate transfer belt 11 by the conductive elastic material.

The toner image transferred onto the outer circumferential surface of the intermediate transfer belt 11 at each of the primary transfer-positions is conveyed to a secondary transfer position, which is a position facing the secondary transfer roller 14, by the rotation of the intermediate transfer belt 11. The secondary transfer roller 14 is brought into pressure-contact with, at a predetermined nip pressure, the outer circumferential surface of the intermediate transfer belt 11 whose inner circumferential surface is in contact with a circumferential surface of the driving roller 11*a* during image formation. While a recording sheet fed from the paper feeding cassette 16 or the manual paper feeding tray 17 passes between the secondary transfer roller 14 and the intermediate transfer belt 11, a high voltage with the opposite polarity to the charging polarity of the toner is applied to the secondary transfer roller 14. Thus, the toner image is transferred from the outer circumferential surface of the intermediate transfer belt 11 to the surface of the recording sheet.

Note that, of the toner adhered from the photoreceptor drums 101 to the intermediate transfer belt 11, toner that has not been transferred onto the recording sheet and remains on the intermediate transfer belt 11 is collected by a transfer cleaning unit 12 in order to prevent color mixture in the following process.

The recording sheet onto which the toner image has been transferred is guided to the above-described fixing devices 15, 35, and 45 of the invention so as to pass through the fixing nip region formed between the fixing belt 25 that is supported around the fixing roller 15*a* and the heating members 20, 40 and 50 with tensions and the pressure roller 15*b* to be heated and pressed. Thus, the toner image is firmly fixed on the surface of the recording sheet. Since the fixing devices 15, 35, and 45 perform fixing in the image forming apparatus 100, it is possible to cause the recording sheet to pass through the fixing nip region in a state where variance of a fixing temperature of the toner is prevented, and to form an image having high printing quality. The recording sheet on which the toner image has been fixed is discharged by paper discharge rollers 18*a* onto the catch tray 18.

Moreover, the image forming apparatus 100 is provided with the paper conveyance path P1 extending in the substantially vertical direction, for feeding a recording sheet contained in the paper feeding cassette 16 through a region between the secondary transfer roller 14 and the intermediate transfer belt 11, and by way of the fixing device 15, to the catch tray 18. The paper conveyance path P1 is provided with a pickup roller 16*a* for picking up recording sheets in the paper feeding cassette 16 in the paper conveyance path P1 sheet by sheet, conveying rollers 16*b* for conveying the fed recording sheet upward, registration rollers 19 for guiding the conveyed recording sheet between the secondary transfer roller 14 and the intermediate transfer belt 11 at a predetermined timing, and the paper discharge rollers 18*a* for discharging the recording sheet onto the catch tray 18.

Moreover, inside the image forming apparatus 100, the paper conveyance path P2 on which a pickup roller 17*a* and conveying rollers 16*b* are disposed is formed between the manual paper feeding tray 17 and the registration rollers 19. In addition, the paper conveyance path P3 is formed between the paper discharge rollers 18*a* and the upstream side of the registration rollers 19 in the paper conveyance path P1.

The paper discharge rollers 18*a* freely rotate in both forward and reverse directions, and are driven in the forward direction to discharge a recording sheet onto the catch tray 18 during single-sided image formation in which images are formed on one side of the recording sheets, and during second side image formation of double-sided image formation in which images are formed on both sides of the recording sheet. On the other hand, during first side image formation of double-sided image formation, the paper discharge rollers 18*a* are driven in the forward direction until a tail edge of the sheen passes through the fixing device 15, and are then driven in the reverse direction to bring the recording sheet into the paper conveyance path P3 in a state where the tail edge of the recording sheet is held. Thus, the recording sheet on which an image has been formed only on one side during double-sided image formation is brought into the paper conveyance path P1 in a state where the recording sheet is turned over and upside down.

The recording sheet that has been fed from the paper feeding cassette 16 or the manual paper feeding tray 17, or has been conveyed through the paper conveyance path P3 is brought by the registration rollers 19 between the secondary transfer roller 14 and the intermediate transfer belt 11 at a timing synchronized with the rotation of the intermediate transfer belt 11. Thus, the rotation of the registration rollers 19 is stopped when the operation of the photoreceptor drums 101 or the intermediate transfer belt 11 is started, and the movement of the recording sheet that has been fed or conveyed prior to the rotation of the intermediate transfer belt 11 is stopped in the paper conveyance path P1 in a state where a leading edge thereof abuts against the registration rollers 19. Then, the rotation of the registration rollers 19 is started at a timing when the leading edge of the recording sheet faces a leading edge of a toner image formed on the intermediate transfer belt 11 at a position where the secondary transfer roller 14 is brought into pressure-contact with the intermediate transfer belt 11.

Note that, during full-color image formation in which image formation is performed by all of the image forming sections Pa to Pd, all of the primary transfer rollers 13*a* to 13*d* bring the intermediate transfer belt 11 into pressure-contact with the photoreceptor drums 101*a* to 101*d*. On the other hand, during monochrome image formation in which image formation is performed only by the image forming section Pa, only the primary transfer roller 13*a* brings the intermediate transfer belt 11 into pressure-contact with the photoreceptor drum 101*a*.

EXAMPLES

Although the invention will hereinafter be described in detail with reference to examples, the invention will not be limited to these examples.

Example 1

A fixing device used in Example 1 was the above-described fixing device 15. The detailed condition in Example 1 was as follows.

<Fixing Roller>

Used was a fixing roller that had a diameter of 30 mm in which stainless steel having a diameter of 15 mm was used as a core metal and silicone sponge rubber having thickness of 7.5 mm was used as an elastic layer.

<Pressure Roller>

Used was a pressure roller that had a diameter of 30 mm and was made of silicone solid rubber, in which PFA tube having thickness of 30 μm was used as a release layer and a heater lamp having a rated power of 400 W was disposed inside.

<Fixing Belt>

Used was a fixing belt in which polyimide having thickness of 70 μm was used as a belt substrate, silicone rubber having thickness of 150 μm was used as an elastic layer, and PFA tube having thickness of 30 μm was used as a release layer, and whose winding angle θ was 185°.

<Meandering Prevention Collar>

A polyphenylene sulfide (PPS) collar having an inner diameter of 20 mm, a diameter of 32 mm, and a width of 7 mm was disposed so as to be in contact with an end of the fixing belt.

<Heating Member>

Substrate: Used was an aluminum pipe having thickness of 1 mm in which a body section had a diameter of 28 mm and a journal section had a diameter of 20 mm, and an area where the fixing belt slides had a circular shape with 40% thereof cut in a circumferential direction.

Insulating layer of planar heat generating element: Insulating layer having thickness of 30 μm and made of polyimide.

Heat generating layer of planar heat generating element: A length in a longitudinal direction as a direction extending along an axial direction of the fixing roller was 330 mm, and a composite material in which graphite particles were dispersed in a silicone resin (3.3 parts by weight of graphite particles relative to 1 part by weight of a silicone resin) was formed as a heat generating layer on an inner surface of the above-described substrate so that an area of a center part in the longitudinal direction had thickness of 0.5 mm and 30 mm of both ends had thickness of 0.6 mm. Note that, while the length in the longitudinal direction of the heat generating layer was set to 330 mm, the length of each of the both ends was set to 30 mm, thus the length of the center part in the longitudinal direction of the heat generating layer was 270 mm. The length of the center part in the longitudinal direction of the heat generating layer was set to be smaller than a maximum width of a recording sheet.

Coat layer: A fluorine resin coat layer having thickness of 20 μm and made of a mixture of PTFE and PFA to which carbon black was added.

<Thermistor>

As a thermistor on the heat generating element side, a thermistor of a noncontact type was used and as a thermistor on the pressure roller side, a thermistor of a contact type was used.

<Fixing Condition>

Length of fixing nip region: 7 mm (length in a recording sheet conveyance direction of the fixing nip region)

Width of fixing nip region: 325 mm (length corresponding to the axial direction of the fixing roller)

Fixing Speed: 220 mm/sec

Length of heating nip region: 44 mm (length in a recording sheet conveyance direction where the fixing belt and the heating member were in contact with each other)

Width of heating nip region: 330 m (length corresponding to the axial direction of the fixing roller)

Maximum width of recording sheet: 300 mm (length corresponding to the axial direction of the fixing roller)

Heat generated from the planar heat generating element of Example 1 was transmitted to the fixing belt through the substrate. Since both ends in a longitudinal direction of the heat generating layer of the planar heat generating element had larger thickness than that of the center part thereof, a power density was 6.6 W/cm$^2$ at the center part and 7.2 W/cm$^2$ at the both ends. Whereby, unevenness of a temperature in the surface of the fixing belt due to loss in heat radiation from the both ends in the longitudinal direction of the planar heat generating element was suppressed and there was no offset, thus fixing property of a toner image on the recording sheet was also uniform.

In addition, the planar heat generating element had a positive resistance temperature characteristic showing sudden rise in electric resistance at around 230° C. Since the current supplied from an electrode attached to the planar heat generating element flowed in a direction in which the fixing belt slid and a direction in which the recoding sheet was conveyed, even when a temperature of a non-sheet passing end tended to rise during continuous printing of recording sheets having different sizes, the current of that part was suppressed by rise in electric resistance, thus more excessive rise could be suppressed. Accordingly, it was possible not only to secure safety and maintain a life of a fixing member but to perform image formation on a recording sheet in a state of power saving.

Example 2

A fixing device used in Example 2 was the above-described fixing device 35. Example 2 was conducted in the similar manner to Example 1 except that the heating member was different.

<Heating Member>

A polyimide layer of 30 μm as an insulating layer was formed on an outer surface of a substrate made of an aluminum pipe having thickness of 1 mm and provided with steps at both ends thereof, and on the outer surface thereof, a composite material in which graphite particles were dispersed in a silicone resin (3.3 parts by weight of graphite particles relative to 1 part by weight of a silicone resin) was formed as a heat generating layer so that an area of a center part in the longitudinal direction had thickness of 0.5 mm and 30 mm of both ends thereof had thickness of 0.6 mm. In addition, as a coat layer of the outermost layer, a fluorine resin having thickness of 20 μm was coated. The others were similar to Example 1.

Heat generated from the planar heat generating element of Example 2 was transmitted to the fixing belt through the coat layer. Since both ends in a longitudinal direction of the heat generating layer of the planar heat generating element had larger thickness than that of the center part thereof, similarly to Example 1, a power density was 6.6 W/cm$^2$ at the center part and 7.2 W/cm$^2$ at the both ends. Whereby, unevenness of a temperature in the surface of the fixing belt due to loss in heat radiation from the both ends in the longitudinal direction of the planar heat generating element was suppressed and there was no offset, thus fixing property of a toner image on the recording sheet was also uniform.

In addition, the planar heat generating element had a positive resistance temperature characteristic showing sudden rise in electric resistance at around 230° C. Since the current supplied from an electrode attached to the planar heat generating element flowed in a direction in which the fixing belt slid and a direction in which the recording sheet was conveyed, even when a temperature of a non-sheet passing end tended to rise during continuous printing of recording sheets having different sizes, the current of that part was suppressed by rise in electric resistance, thus more excessive rise could be suppressed. Accordingly, it was possible not only to secure safety and maintain a life of a fixing member but to perform image formation on a recording sheet in a state of power saving with small power consumption.

Example 3

A fixing device used in Example 3 was the above-described fixing device 45. Example 3 was conducted in the similar manner to Example 1 except that the heating member was different.

<Heating Member>

The heating member was obtained by shaping, as a heat generating layer, semiconductor ceramics based on barium titanate with Curie temperature of 250° C. into a semicircular roller shape so as to have an external diameter of 28 mm, thickness of 2 mm, and a length in an axial direction of 350 mm; and providing, on the surface of which, a coat layer made of a fluorine resin having thickness of 20 μm used in Example 1. At this time, thickness of the heat generating layer was set so that both ends in a longitudinal direction thereof had larger thickness than that of a center part thereof, similarly to Example 1. Except for the heating members the others were similar to Example 1.

In the heating member of Example 3, heat generated from the heat generating layer was not transmitted indirectly to the fixing belt through at least one of the substrate and the extra layer, like in Examples 1 and 2, but transmitted to the fixing belt only through the coat layer.

Since the both ends in the longitudinal direction of the heat generating layer had larger thickness than that of the center part thereof, an electric density of the both ends was higher than that of the center part, similarly to Example 1. Whereby, unevenness of a temperature in the surface of the fixing belt due to loss in heat radiation from the both ends in the longitudinal direction of the heat generating layer was suppressed and there was no offset, thus fixing property of a toner image on the recording sheet was also uniform. Further, in the case of printing of recording sheets having different sizes, even when a temperature of non-sheet passing both ends tended to rise, the current of that part was suppressed by rise in electric resistance, thus more excessive rise could be suppressed. In addition, there was no problem in a time required for warm up and it was possible to perform image formation on recording sheets in a state of power saving with small power consumption.

Comparative Example 1

Comparative example 1 was conducted in the similar manner to Example 1 except that a heating member that a composite material in which graphite particles were dispersed in a silicone resin (3.3 parts by weight of graphite particles relative to 1 part by weight of a silicone resin) was formed as the heat generating layer on an inner surface of the substrate so that the entire areas of a center part in the longitudinal direction and the both ends had thickness of 0.5 mm, was used.

As a temperature of the heat generating layer increased, temperature difference was generated between the both ends in the longitudinal direction of the fixing belt and the area of the center part thereof, and heat radiation volume in the heat generating layer was adjusted in order to adjust the temperature of the both ends in the longitudinal direction of the fixing belt, but a balance with a fixing temperature in the fixing belt could not be adjusted, thus fixing property of a toner image on a recording sheet was not uniform. Accordingly, it was impossible to secure image formation with high image quality.

Comparative Example 2

Comparative example 2 was conducted in the similar manner to Example 1 except that, as a heating member, a substrate made of an aluminum roller having a diameter of 28 mm and thickness of 1 mm and having a coat layer made of fluorine resin used in Example 1 on the outer surface thereof was used, and to the inside of which, an etching heater (single heat generating element) of an SUS foil, (having uniform thickness of 30 μm) with about 1000 W was attached using silicone based adhesive as the heat generating layer.

As a temperature of the heat generating layer increased, temperature difference was generated between the both ends in the longitudinal direction of the fixing belt and the area of the center part thereof, and heat radiation volume in the heat generating layer was adjusted in order to adjust the temperature of the both ends in the longitudinal direction of the fixing belt, but a balance with a fixing temperature in the fixing belt could not be adjusted, thus fixing property of a toner image on a recording sheet was not uniform. Accordingly, it was impossible to secure image formation with high image quality. In addition, in the case of continuous printing of recording sheets having different sizes, the temperature of the both ends in the longitudinal direction of the fixing belt increased excessively, and an operation to suppress it is required, resulting in an operation with low productivity and not excellent in energy saving performance.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device comprising:

a fixing roller;

a heating member;

an fixing belt supported around the fixing roller and the heating member with tension, wherein the fixing belt is endless, and;

a pressure member facing the fixing roller with the fixing belt interposed therebetween, the heating member being in contact with the fixing belt to heat the fixing belt, and in a fixing nip region formed by the fixing belt and the pressure member, a toner image borne on a recording medium being heated and pressurized to be fixed on the recording medium, wherein a heating section that is in contact with the fixing belt to heat the fixing belt in the heating member is formed with a planar heat generating element that extends along an axial direction of the fixing roller and has a positive resistance temperature characteristic;

wherein the planar heat generating element includes a first electrode and a second electrode, where the electrodes are at both ends in a circumferential direction of the planar heat generating element so that current flows only in one direction from the first electrode to the second electrode throughout the planar heat generating element and the one direction is a direction substantially orthogonal to a longitudinal direction which is a direction extending along the axial direction of the fixing roller in the planar heat generating element, and has a heat generating layer that generates heat when current is supplied from the electrode, and the heat generating layer is constituted so that both ends in a longitudinal direction of the heat generating layer have larger thickness than that of a center part thereof;

wherein the heating section of the heating member is formed with the planar heat generating element on an outer or inner circumferential surface of a substrate having a substantially semicircular shape made of a material having high thermal conductivity, and has a coat layer capable of reducing a frictional force between the fixing belt and the heating member on a surface in the side in contact with the fixing belt;

wherein the planar heat generating element has at least the heat generating layer that generates heat by current supplied from the electrode and an insulating layer; and wherein the heat generating layer is made of a composite material in which heat-resistant polymer of an organic material or an organic and inorganic composite is filled with a conductive filler.

2. The fixing device of claim 1, wherein a length of the center part in the longitudinal direction of the heat generating layer is shorter than a maximum width of a recording medium that passes through the fixing nip region.

3. The fixing device of claim 1, wherein the fixing roller and the heating member are substantially in parallel to each other in the axial direction of the fixing roller.

4. An image forming apparatus comprising the fixing device of claim 1.

5. A fixing device comprising:

a fixing roller;

a heating member;

an fixing belt supported around the fixing roller and the heating member with tension, wherein the fixing belt is endless, and;

a pressure member facing the fixing roller with the fixing belt interposed therebetween, the heating member being in contact with the fixing belt to heat the fixing belt, and in a fixing nip region formed by the fixing belt and the pressure member, a toner image borne on a recording medium being heated and pressurized to be fixed on the recording medium, wherein a heating section that is in contact with the fixing belt to heat the fixing belt in the heating member is formed with a planar heat generating element that extends along an axial direction of the fixing roller and has a positive resistance temperature characteristic;

wherein the planar heat generating element includes a first electrode and a second electrode, where the electrodes are at both ends in a circumferential direction of the planar heat generating element so that current flows only in one direction from the first electrode to the second electrode throughout the planar heat generating element and the one direction is a direction substantially orthogonal to a longitudinal direction which is a direction extending along the axial direction of the fixing roller in the planar heat generating element, and has a heat generating layer that generates heat when current is supplied from the electrode, and the heat generating layer is constituted so that both ends in a longitudinal direction of the heat generating layer have larger thickness than that of a center part thereof;

wherein the heating section of the heating member is constituted only by the planar heat generating element that has the heat generating layer that generates heat by current supplied from the electrode and is formed into a substantially semicircular shape;

wherein the planar heat generating element has a coat layer capable of reducing a frictional force between the fixing belt and the heating member on a surface in the side in contact with the fixing belt; and wherein the heat generating layer is made of semiconductor ceramics.

6. The fixing device of claim 5, wherein a length of the center part in the longitudinal direction of the heat generating layer is shorter than a maximum width of a recording medium that passes through the fixing nip region.

7. The fixing device of claim 5, wherein the fixing roller and the heating member are substantially in parallel to each other in the axial direction of the fixing roller.

8. An image forming apparatus comprising the fixing device of claim 5.

* * * * *